US005484006A

United States Patent [19]

Walker

[11] Patent Number: 5,484,006

[45] Date of Patent: Jan. 16, 1996

[54] CORNICE BOX

[76] Inventor: Whitney A. Walker, 3001 Maple St., No. 702, Dallas, Tex. 75219

[21] Appl. No.: 283,991

[22] Filed: Aug. 1, 1994

[51] Int. Cl.[6] ..... E04F 10/00

[52] U.S. Cl. ..... 160/38; 160/19

[58] Field of Search ..... 160/19, 38, 39; 229/193, 198, 198.1, 198.3

[56] References Cited

U.S. PATENT DOCUMENTS

| | | | |
|---|---|---|---|
| 657,197 | 9/1900 | Hills | 229/198.3 X |
| 2,243,222 | 5/1941 | Rebholz . | |
| 2,315,033 | 3/1943 | Adair . | |
| 2,375,247 | 5/1945 | Rebholz . | |
| 2,415,330 | 2/1947 | Bashwiner . | |
| 2,501,133 | 3/1950 | Levy . | |
| 2,539,380 | 1/1951 | Ziemmerman . | |
| 2,602,500 | 7/1952 | Slavin et al. . | |
| 2,862,549 | 12/1958 | Robbins . | |
| 2,894,571 | 7/1959 | Toti . | |
| 4,126,265 | 11/1978 | Holmes | 229/198.1 X |
| 4,948,039 | 8/1990 | Amatangelo . | |
| 5,071,062 | 12/1991 | Bradley et al. | 229/109 |

*Primary Examiner*—Blair M. Johnson
*Attorney, Agent, or Firm*—Baker & Botts

[57] ABSTRACT

A cornice box assembly (10) for forming a cornice box (66) of a desired shape that hangs on a wall (74) is provided. The assembly (10) includes a face member (12) of a lightweight rigid material and first (14) and second (16) side members of the lightweight rigid material. Additionally, the assembly includes a top member (18) of the lightweight rigid material. A back member (20) is also provided of the lightweight rigid material having a first side tab member (50) at a first end and a second side tab member (52) at a second end. Each tab member (50 & 52) may be placed in a position generally perpendicular to the back member (20) at an interface between each tab member (50 & 52) and the back member (20). The assembly (10) also includes an adhesive (22) for joining the members such that a hingeable joint is formed between any two adhesive joined members. The assembly also includes a fastening medium (40) attached to each side member (14 & 16) and a connection medium (58) attached to each back side tab member (50 & 52). The fastening (40) and connection (58) mediums come together so as to hold the cornice box (66) in the desired shape when the cornice box (66) is formed along the hingeable joints with the side members (14 & 16) and back member (20) being generally perpendicular to the face member (12) and the back member (20) is generally parallel to the top member (18). A hanging medium (62) attached to the back member's (20) outside surface is also provided for securing the cornice box (66) to the wall (74).

11 Claims, 3 Drawing Sheets

CORNICE BOX

TECHNICAL FIELD OF THE INVENTION

This invention relates in general to the field of window dressings, and more particularly, to a low cost, lightweight, and easy to assemble cornice box.

BACKGROUND OF THE INVENTION

In the field of interior decorating, cornice or window boxes are used to conceal curtain rods and pins and to provide decorative design and aesthetic appeal to a window. There are several types of cornice boxes currently available. Cornice boxes have traditionally been built from wood. Custom design cornice boxes built by a skilled craftsman, such as a carpenter, are generally expensive and very heavy. The expense of a custom design, all-wood cornice box precludes some people from using this type of cornice box to decorate their windows. Another type of wood cornice box is formed from plywood pieces that are provided in a kit. The pieces of plywood may be glued or nailed together to form a cornice box. These wood-kit cornice boxes are also expensive, heavy, and sometimes difficult to assemble.

Lightweight, inexpensive cornice boxes made from styrofoam have been offered as an alternative to wood cornice boxes. Styrofoam cornice boxes are less expensive and lighter than all-wood cornice boxes, but do not have sufficient durability for use over long periods of time.

Lightweight, inexpensive cornice boxes formed from cardboard have been offered as an alternative to all-wood and styrofoam cornice boxes. Unfortunately, these cardboard cornice boxes of the prior art are difficult to assemble and require fastening hardware in order to hold the box together and to mount the box to a wall.

SUMMARY OF THE INVENTION

In accordance with the present invention, a cornice box is provided that substantially eliminates or reduces the disadvantages and problems associated with prior developed cornice boxes.

One aspect of the present invention provides a cornice box assembly for forming a cornice box of a desired shape that hangs on a wall. The assembly includes a face member of a lightweight rigid material having first and second side edges and top and bottom edges. The assembly also includes first and second side members of the lightweight rigid material each having inside and outside surfaces and inside, outside, top, and bottom edges. A top member of the lightweight rigid material having top and bottom edges is also provided with the assembly. Additionally, the assembly includes a back member of the lightweight rigid material having a first side tab member at a first end and a second side tab member at a second end. The back member, first tab member, and second tab member, each have top and bottom edges and inside and outside surfaces, with each tab member being capable of being placed in a position generally perpendicular to the back member at an interface between each tab member and the back member. The assembly also includes an adhesive for joining the face member's first side edge with the first side member's inside edge, the face member's second side edge with the second side member's inside edge, the face member's top edge with the top member's bottom edge, and the top member's top edge with the back member's bottom edge, so that a hingeable joint is formed between any two adhesive joined members. A fastening medium is included with the assembly and is attached to each side member's inside surface near each side member's top edge, and a connection medium is included that is attached to each back side tab member's outside surface. The fastening and connection mediums come together to hold the cornice box in the desired shape when the cornice box is formed along the hingeable joints with the side members and back member generally perpendicular to the face member and the back member generally parallel to the face member. The cornice box assembly also includes a hanging medium attached to the back member's outside surface for securing the cornice box to the wall.

Another aspect of the present invention provides a method for forming the cornice box from the cornice box assembly. The method includes joining with an adhesive the face member's first side edge with the first side member's inside edge, the face member's second side edge with the second side member's inside edge, the face member's top edge with the top member's bottom edge, and the top member's top edge with the back member's bottom edge, such that a hingeable joint is formed between any two adhesive joined members. Next, the method includes positioning each of the side members at a perpendicular position with respect to the face member by folding each side member up with respect to the face member at the hingeable joint between each side member and the face member. The next step in the method is to position the top member at a perpendicular position with respect to the face member by folding the top member up with respect to the face member at the hingeable joint between the top member and the face member. The next step is to position the back member in a plane parallel to the plane of the face member by folding the back member down with respect to the top member at the hingeable joint between the back member and the top member. By securing each side member to an associated back tab member with a fastening medium attached to each side member and a connection medium attached to each back tab, the desired shape of the cornice box will be maintained.

The present cornice box provides several technical advantages. The present cornice box is relatively inexpensive. Because it is formed primarily from cardboard, it is lightweight and easy to mount to a wall over a window. Another technical advantage of the present invention is that it is easy to assemble and can be assembled with common household tools.

Another technical advantage of the present invention is that it can be cut to fit many window shapes. The face of the present cornice box may also be cut into a decorative design to give the box additional aesthetic appeal.

Yet another technical advantage of the present invention is its durability. The cornice box of the present invention provides a sturdy structure to which decorative material may be attached. Another technical advantage of the present invention is that the decorative material can be attached to the cornice box with common fasteners like staples.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Preferred embodiments of the present invention are illustrated in FIGS. 1 through 4, like numerals being used to refer to like and corresponding parts of the various drawings.

Figure 1:
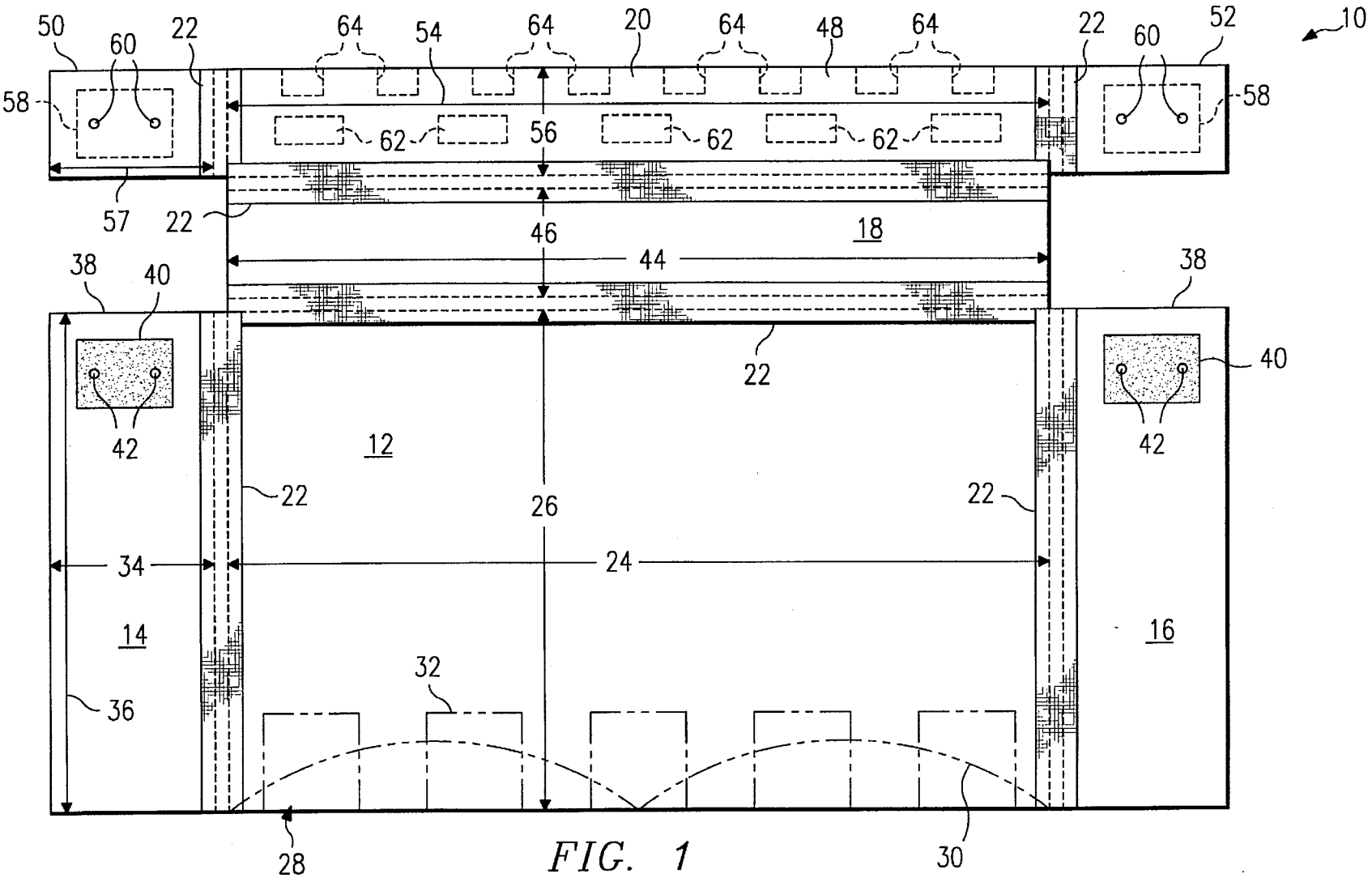
FIG. 1 is a top plan view of one configuration of a cornice box assembly in accordance with the present invention.

FIG. 1 is a backside view of the pieces of cornice box assembly 10 that may be used to form a cornice box in accordance with the present invention. All of the pieces of cornice box assembly 10 are generally flat and may be constructed of a lightweight rigid material such as cardboard, and in the preferred embodiment tri-wall cardboard is used. The thickness of each piece of cornice box assembly 10 is generally uniform with each piece being generally of the same thickness. Using cardboard in cornice box assembly 10 helps achieve the technical advantages of lightweight and low cost of the present invention.

Cornice box assembly 10 includes face 12, first side 14, second side 16, top 18, and back 20. These pieces of cornice box assembly 10 may be provided separated from one another. The connecting edges of each piece of assembly 10 are shown in dashed lines as these edges are covered by adhesive 22 when assembled with one another. In the preferred embodiment, the pieces of cornice box assembly 10 are provided to the user assembled with the adhesive as shown in FIG. 1.

Face 12 of assembly 10 is generally a flat piece of cardboard. Dimensions typical for face 12 would be width 24 on the order of three feet, six inches and depth 26 on the order of 18 inches. It is noted that any dimensions provided in describing the present invention are by way of example only and can be varied without departing from its inventive concepts.

Also shown in FIG. 1 on the inside surface of face 12 are decorative design tracings 28, including scallop decorative design 30 and castle decorative design 32. Face 12 may be provided with decorative design tracings 28 drawn on the inside surface of face 12 in order to facilitate the cutting of a decorative design into face 12. In order to form a decorative design in face 12, one of decorative design tracings 28 merely must be traced with a knife to cut away the unnecessary parts of face 12. The decorative design tracings that may be provided on the inside surface of face 12 are not limited to those depicted in FIG. 1. Additionally, a user of cornice box assembly 10 can create his or her own decorative design on the inside surface of face 12 and then cut away the unnecessary portions of face 12.

Cornice box assembly 10 of FIG. 1 also includes sides 14 and 16 that are generally of equal dimensions. Each side has width 34 on the order of six inches and depth 36 on the order of 18 inches. Located near top edge 38 of sides 14 and 16 are fastening medium 40. Fastening medium 40 may be embodied in double sided tape or, in the preferred embodiment, a hook and loop fastening material commonly known as Velcro™. When Velcro™ is used, fastening medium 40 would preferably be the loop portion of the Velcro™. Additionally, each side 14 and 16 may include holes 42 sized for receiving fastening hardware such as, for example, a screw or bolt. When holes 42 are included in sides 14 and 16, they would be located approximately where shown in FIG. 1.

Top 18 of cornice box assembly 10 is also formed from a flat piece of cardboard. Dimensions for top 18 would be width 44 on the order of three feet, six inches and depth 46 on the order of six inches.

Back 20 of cornice box assembly 10 is also formed from a flat piece of cardboard and includes center section 48 and side tabs 50 and 52. Dimensions for center section 48 are width 54 on the order of three feet, six inches and depth 56 on the order of four inches. The depth of sides 50 and 52 is the same as depth 56 of center section 48, while width 57 may be on the order of five and one-half inches.

In the preferred embodiment of back 20, side tabs 50 and 52 are formed from the same piece of material as center section 48. In this embodiment a bend may be formed between each tab and center section 48 at their interface. In the embodiment shown in FIG. 1, side tabs 54 and 56 are separate pieces from center portion 52.

On the reverse side of each side tab, shown in dotted line format, is connection medium 58. Connection medium 58 may be double sided tape, or in the preferred embodiment is the matching hook portion of Velcro™ to fastening medium 40 on each side 14 and 16. Tabs 54 and 56 may also include holes 60 where shown that align with holes 42 in the respective sides 14 and 16. Holes 60 are also sized to receive fastening hardware when inserted through holes 42 in sides 14 and 16.

FIG. 1 also shows hanging medium 62 in dotted line format on the opposite side of center section 48 of back 20. Hanging medium 62 may be any appropriate adhesive material including double sided tape. In the preferred embodiment, hanging medium 62 is embodied in the hook and fastening material Velcro™. When hanging medium 62 is Velcro™, the loop portion of the Velcro™ is preferably attached to back 20 and the hook portion of the Velcro™ is mounted to the wall. Bringing the hook and loop portion of the Velcro™ together will attach the cornice box of the present invention to a wall.

Also shown on back 20 in FIG. 1 are optional cutouts 64. Back 20 may be supplied with optional cutouts 64 removed, or alternatively, cutouts 64 can be removed by the user of cornice box assembly 10. Removing cutouts 64 forms a series of protrusions that may be used for attaching the cornice box to a wall with a clamp or bracket.

When using cornice box assembly 10 shown in FIG. 1, the first step is to determine the desired size for the cornice box. The window where the cornice box will hang should be measured, and the width of the cornice box should be set to exceed the window's width by approximately six inches. When cornice box assembly 10 is provided as a single assembled piece, the portion that must be removed from face 12, top 18, and back 20 can be cut from their center section. The two halves, less the removed portion can then be rejoined with additional adhesive 22.

When cornice box assembly 10 is provided as separate pieces it will be necessary to cut each piece to the desired width. Once the width of the window is determined, then face 12 can be cut to the desired dimension. Because face 12 is formed from cardboard, it may be cut with a commonly available knife. A serrated knife is the preferred knife for cutting the pieces of assembly 10. Additionally, scissors may be used to cut the pieces of cornice box assembly 10 to the desired dimensions. Tri-wall cardboard has been found to cut very clearly in this manner without ragged edges. Once width 24 of face 12 is cut, top 18 and back 20 should be cut to the same width.

Depth 26 of the cornice box can also be tailored to a window. Depth 26 of face 12 can be measured and then cut with a knife. Sides 14 and 16 can then be cut to the same dimension, noting that cutting of sides 14 and 16 should be at the bottom, so as to leave fastening medium 40 in place.

Next, it may be desirable to form a decorative design in face 12. This can be accomplished by cutting out the decorative shapes, e.g., 30 and 32, with a knife. Alternatively, a unique decorative shape can be drawn onto face 12 and cut out by the user of cornice box assembly 10.

In some configurations of cornice box assembly 10, fastening medium 40, connection medium 58, and attachment medium 62 are applied to their corresponding pieces prior to delivery to the user. In other embodiments, it would be necessary to attach fastening medium 40, connection medium 58, and hanging medium 62 to their appropriate pieces where shown in FIG. 1. When Velcro™ is used for these mediums, a sticky-back form of Velcro™ is preferred for attaching the Velcro™ to their respective pieces.

Once the width and depth of the pieces of cornice box assembly 10 are obtained, the pieces may be attached to one another with adhesive 22. Any strong tape will be suitable for adhesive 22 for assembling cornice box assembly 10. In the preferred embodiment, fiber tape or duct tape would be used for adhesive 22. By using a tape adhesive 22 to join the pieces of cornice box assembly 10, hinged joints are formed at the interface of any two pieces. This allows the cornice box to be formed into the desired shape.

Figure 2:
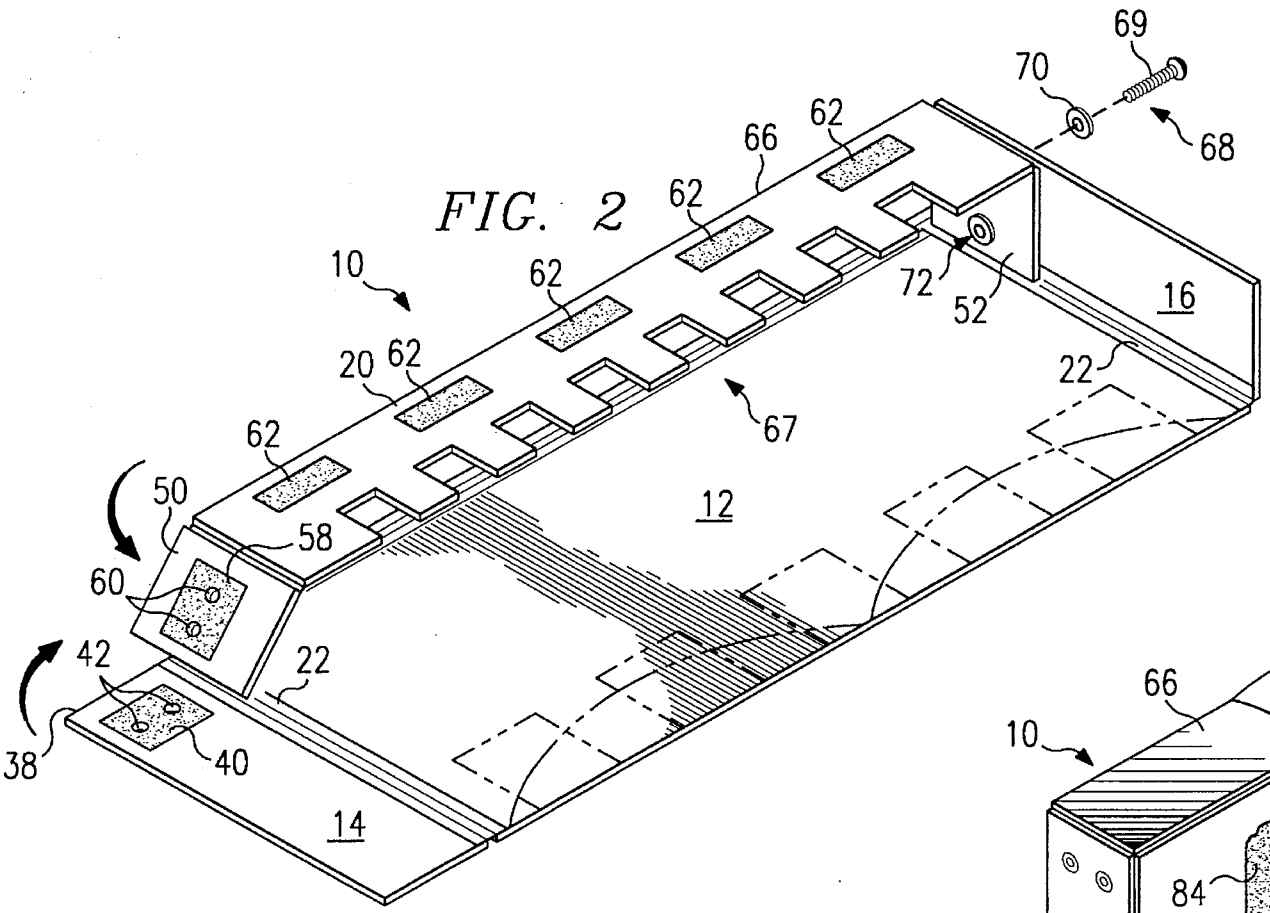
FIG. 2 illustrates in perspective and in elevation an assembled cornice box.

FIG. 2 illustrates cornice box 66 formed from cornice box assembly 10 of FIG. 1. FIG. 2 shows a view looking into opening 67 of cornice box 66. In order to assemble cornice box 66, sides 14 and 16 are folded up at their interface with face 12 until generally perpendicular to face 12. Top 18 is then folded up at its interface with face 12 until generally perpendicular to face 12. Then, back 20 is folded over at its interface with top 18 until it is generally parallel to the plane of face 12. Tabs 50 and 52 of back 20 fold inside of folded up sides 14 and 16 respectively where fastening medium 40 and connection medium 58 are brought together. When Velcro™ is used for fastening 40 and connection 58 medium, the Velcro™ is engaged at this point.

Fastening medium 40 and connection medium 58 are generally sufficient to hold cornice box 66 in its assembled box configuration. It may be desirable to use fastening hardware 68 to additionally secure the configuration of cornice box 66. In one embodiment of fastening hardware 68, bolt 69 is inserted through washer 70, through holes 42 in sides 14 and 16, through holes 60 in tabs 50 and 52, and is secured in nut 72. In this way, fastening hardware 68 adds to the strength of the Velcro™. It is understood that fastening hardware 68 can have numerous embodiments without departing from the inventive concepts of the present invention.

Figure 3:
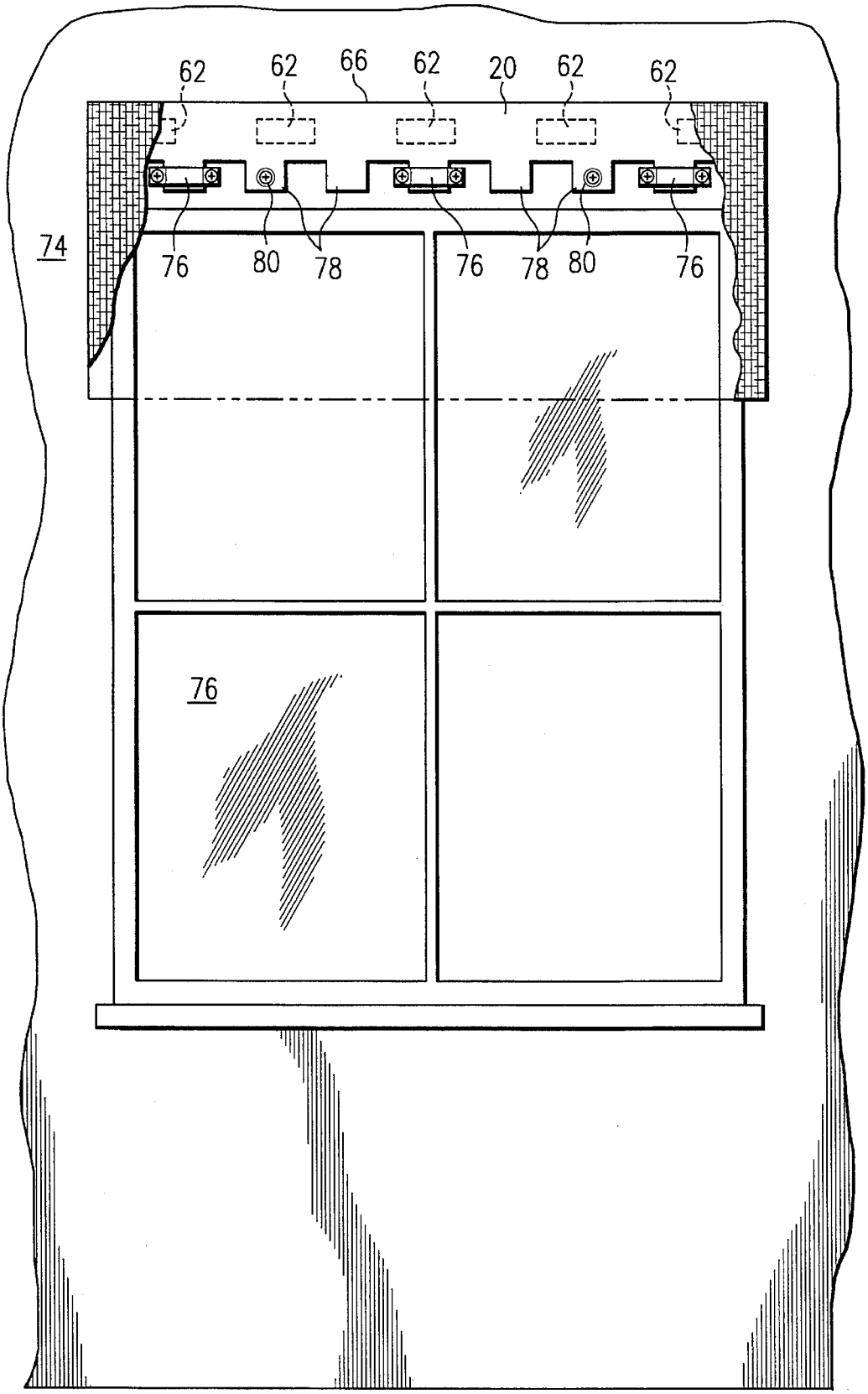
FIG. 3 illustrates the cornice box of the present invention attached to a wall over a window.

FIG. 3 illustrates cornice box 66 attached to wall 74 over window 76. FIG. 3 is a view looking through face 12 towards back 20 of cornice box 66. FIG. 3 illustrates that cornice box 66 may be attached to wall 74 by various methods. FIG. 3 illustrates that hanging medium 62 can be used to secure cornice box 66 to wall 74. In the preferred embodiment, hanging medium 62 is Velcro™ with the hook portion of the Velcro™ mounted on wall 74 and the loop portion of the Velcro™ mounted on back 20 of cornice box 66. FIG. 3 also illustrates that brackets 76 can be used over protrusions 78 that remain when cutouts 64 are removed from back 20 to secure cornice box 66 to wall 74. Additionally, holes 80 can be provided through back 20 so that fastening hardware, such as screws may be used to hold cornice box 66 to wall 74. It is noted that a combination of the brackets, Velcro™, and fastening hardware may be used to attach cornice box 66 to wall 74 without departing from the inventive concepts of the present invention.

Figure 4:
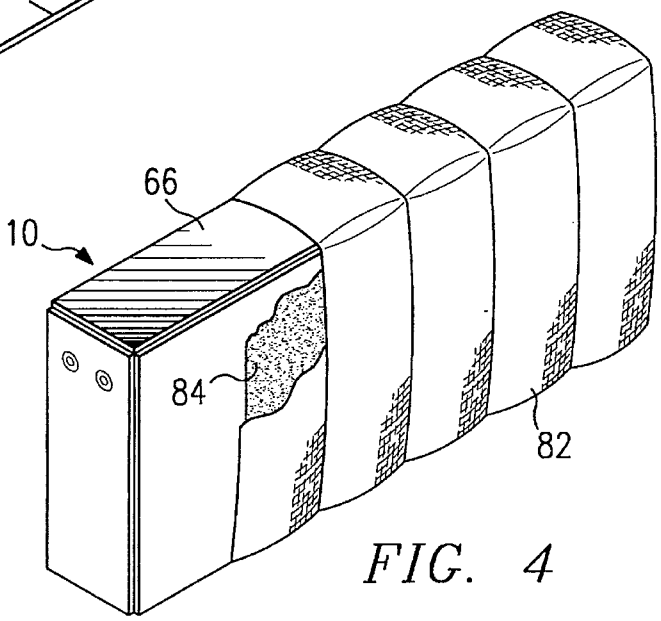
FIG. 4 illustrates a perspective frontal view of the present cornice box that has been covered with decorative material.

FIG. 4 shows a perspective frontal view of the present cornice box with decorative material 82 applied. Prior to applying decorative material 82 to cornice box 66, cotton batting 84 may be attached to face 12 and sides 14 and 16 with a suitable adhesive mechanism such as glue or staples. Once cotton batting 84 is secured to cornice box 66, decorative material 82 may be applied to cornice box 66 and attached thereto. In one embodiment of cornice box 66, the cotton batting 84 is provided attached to the appropriate pieces of cornice box assembly 10. Because cornice box 66 is formed from cardboard, decorative material 82 may be attached to cornice box 66 by glue or staples.

The present inventive cornice box has several technical advantages. It provides for a low cost, lightweight, and easy to assemble cornice box. The cornice box can be sized for any desired window and can also have decorative shapes cut into its face. The present cornice box is environmentally safe and allows for do-it-yourself window decorating.

Although the present invention has been described in detail, it should be understood that various changes, substitutions, and alterations can be made hereto without departing from the spirit and scope of the invention as defined by the appended claims.

What is claimed is:

1. A method for forming a cornice box of a desired shape that hangs on a wall over a window from a cornice box assembly including a face member of a lightweight rigid material having first and second side edges and top and bottom edges; first and second side members of the lightweight rigid material each having inside and outside surfaces and inside, outside, top, and bottom edges; a top member of the lightweight rigid material having top and bottom edges; a back member of the lightweight rigid material having a first side tab member at a first end and a second side tab member at a second end, the back member, first tab member, and second tab member having top and bottom edges and inside and outside surfaces, each tab member may be placed in a position generally perpendicular to the back member at an interface between each tab member and the back member, the method comprising the steps of joining with an adhesive the face member's first side edge with the first side member's inside edge, the face member's second side edge with the second side member's inside edge, the face member's top edge with the top member's bottom edge, and the top member's top edge with the back member's bottom edge, such that a hingeable joint is formed between any two adhesive joined members;

positioning each of the side members at a perpendicular position with respect to the face member by folding each side member up with respect to the face member at the hingeable joint between each side member and the face member;

positioning the top member at a perpendicular position with respect to the face member by folding the top member up with respect to the face member at the hingeable joint between the top member and the face member;

positioning the back member in a plane parallel to the plane of the face member by folding the back member down with respect to the top member at the hingeable joint between the back member and the ton member;

securing each side member to an associated back tab member with a fastening medium attached to each side member's inside surface near each side member's top edge and a connection medium attached to each back tab's outside surface so as to hold the cornice box in the desired shape;

covering the formed cornice box with a backing once the box is in the desired shape; and covering the backing with a decorative material and securing the decorative material to the cornice box.

2. A cornice box assembly for forming a cornice box of a desired shape that hangs on a wall, the assembly comprising:

a face member of a lightweight rigid material having first and second side edges and top and bottom edges;

first and second side members of the lightweight rigid material each having inside and outside surfaces and inside, outside, top, and bottom edges;

a top member of the lightweight rigid material having top and bottom edges;

a back member of the lightweight rigid material having a first side tab member at a first end and a second side tab member at a second end, the back member, first tab member, and second tab member having top and bottom edges and inside and outside surfaces, each tab member may be placed in a position generally perpendicular to the back member at an interface between each tab member and the back member;

an adhesive for joining the face member's first side edge with the first side member's inside edge, the face member's second side edge with the second side member's inside edge, the face member's top edge with the top member's bottom edge, and the top member's top edge with the back member's bottom edge, such that a hingeable joint is formed between any two adhesive joined members;

a fastening medium attached to each side member's inside surface near each side member's top edge;

a connection medium attached to each back side tab member's outside surface;

wherein the fastening and connection mediums come together so as to hold the cornice box in the desired shape when the cornice box is formed along the hingeable joints with the side members and back member generally perpendicular to the face member and the back member generally parallel to the face member; and a hanging medium attached to the back member's outside surface for securing the cornice box to the wall.

3. The assembly of claim 2 wherein the adhesive further comprises fiber-tape and wherein the lightweight rigid material is tri-wall cardboard.

4. The assembly of claim 2 wherein the lightweight rigid material is cardboard.

5. The assembly of claim 2 wherein the face member further comprises a decorative design tracing on one surface of the face member proximal to the face member's bottom edge, and wherein a decorative design can be cut into the face member by cutting along the decorative design tracing.

6. The assembly of claim 2 wherein one of the fastening medium and connection medium comprises a loop portion of a loop and hook fastening material and the other medium comprises the hook portion of the loop and hook fastening material.

7. The assembly of claim 2 wherein the adhesive further comprises tape.

8. The assembly of claim 2 further comprising fastening hardware for securing each of the back tab members to its associated side member when the cornice box is formed into the desired shape.

9. The assembly of claim 2 wherein the hanging medium further comprises one of a loop portion and a hook portion of a loop and hook fastening material while the other portion of the loop and hook material is attached to the wall.

10. The assembly of claim 2 wherein the back member further comprises a plurality of protrusions extending from the back member's top edge for securing the cornice box to the wall with one of a plurality of clamps and brackets.

11. The assembly of claim 2 wherein the back member further comprises a plurality of holes sized to receive securing hardware for attaching the cornice box to the wall.

* * * * *